United States Patent [19]

Laure

[11] Patent Number: 4,793,614

[45] Date of Patent: Dec. 27, 1988

[54] PLASTIC BOWLING PIN

[75] Inventor: George R. Laure, Kalamazoo, Mich.

[73] Assignee: The W-L Molding Company, Portage, Mich.

[21] Appl. No.: 119,804

[22] Filed: Nov. 12, 1987

[51] Int. Cl.[4] ..... A63R 9/00

[52] U.S. Cl. ..... 273/82 R; 273/DIG. 4

[58] Field of Search ..... 273/83, 84 R, 67 R, 273/72 A, DIG. 16, 82, DIG. 4, DIG. 2

[56] References Cited

U.S. PATENT DOCUMENTS

| | | | |
|---|---|---|---|
| 1,583,824 | 5/1926 | Bishop | 273/82 R |
| 3,169,766 | 2/1965 | Ernst | 273/82 R |
| 3,229,978 | 1/1966 | Guglielimo | 273/82 R |
| 3,231,274 | 1/1966 | Wanders | 273/82 R |
| 3,251,598 | 5/1966 | Craig et al. | 273/82 R |
| 3,268,636 | 8/1966 | Angell | 273/82 |
| 3,301,560 | 1/1967 | Satchell et al. | 273/82 |
| 3,329,430 | 7/1967 | Wanders | 273/82 R |
| 3,346,258 | 10/1967 | Schimansky et al. | 273/82 |
| 3,478,134 | 11/1969 | Grasso et al. | 273/82 R |
| 3,572,271 | 3/1971 | Negrini | 273/82 R |
| 3,580,577 | 5/1971 | Hyde et al. | 273/82 R |
| 3,971,837 | 7/1976 | Hasegawa et al. | 273/82 R |
| 3,984,104 | 10/1976 | Negrini | 273/82 R |
| 4,012,386 | 3/1977 | Davis | 273/82 |
| 4,123,057 | 10/1978 | Murray | 273/82 R |
| 4,165,875 | 8/1979 | Dykehouse | 273/82 |
| 4,210,992 | 7/1980 | Murray | 273/82 R |
| 4,351,786 | 9/1982 | Mueller | 273/82 |

*Primary Examiner*—Richard C. Pinkham
*Assistant Examiner*—Mark S. Graham
*Attorney, Agent, or Firm*—Flynn, Thiel, Boutell & Tanis

[57] ABSTRACT

A bowling pin defined primarily by a main one-piece plastic body part which defines the outside configuration of the pin and has a substantially planar base surface on the lower end thereof. A bore arrangement extends coaxially upwardly within the interior of the main body part and terminates just short of the upper end of the pin. A plug closes off the lower end of the bore arrangement. The closed bore arrangement includes a cylindrical bore of large diameter which is found is the base portion of the pin and projects upwardly to a location substantially at the elevation of the maximum pin diameter, from which a significantly reduced diameter bore projects upwardly to a further bore which is somewhat larger and is located adjacent the upper extremity of the base portion of the pin. A further smaller diameter bore thence projects upwardly through the neck portion of the pin and to the head portion so as to terminate at a wall spaced slightly downwardly from the upper extremity of the pin.

3 Claims, 1 Drawing Sheet

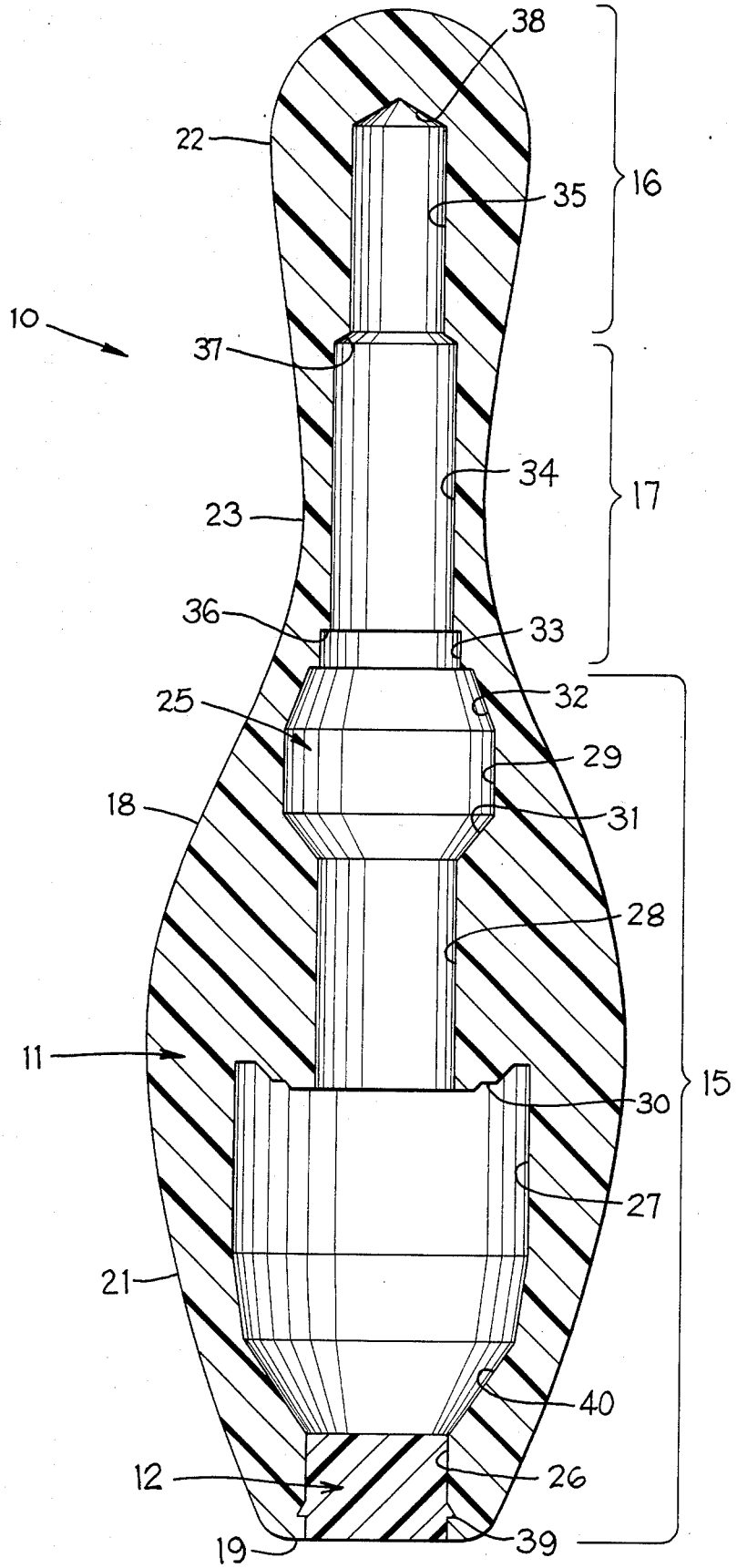
38
22
35
16
10
37
34
17
23
36
33
32
25
29
18
31
28
11
15
30
27
21
40
12
26
19
39

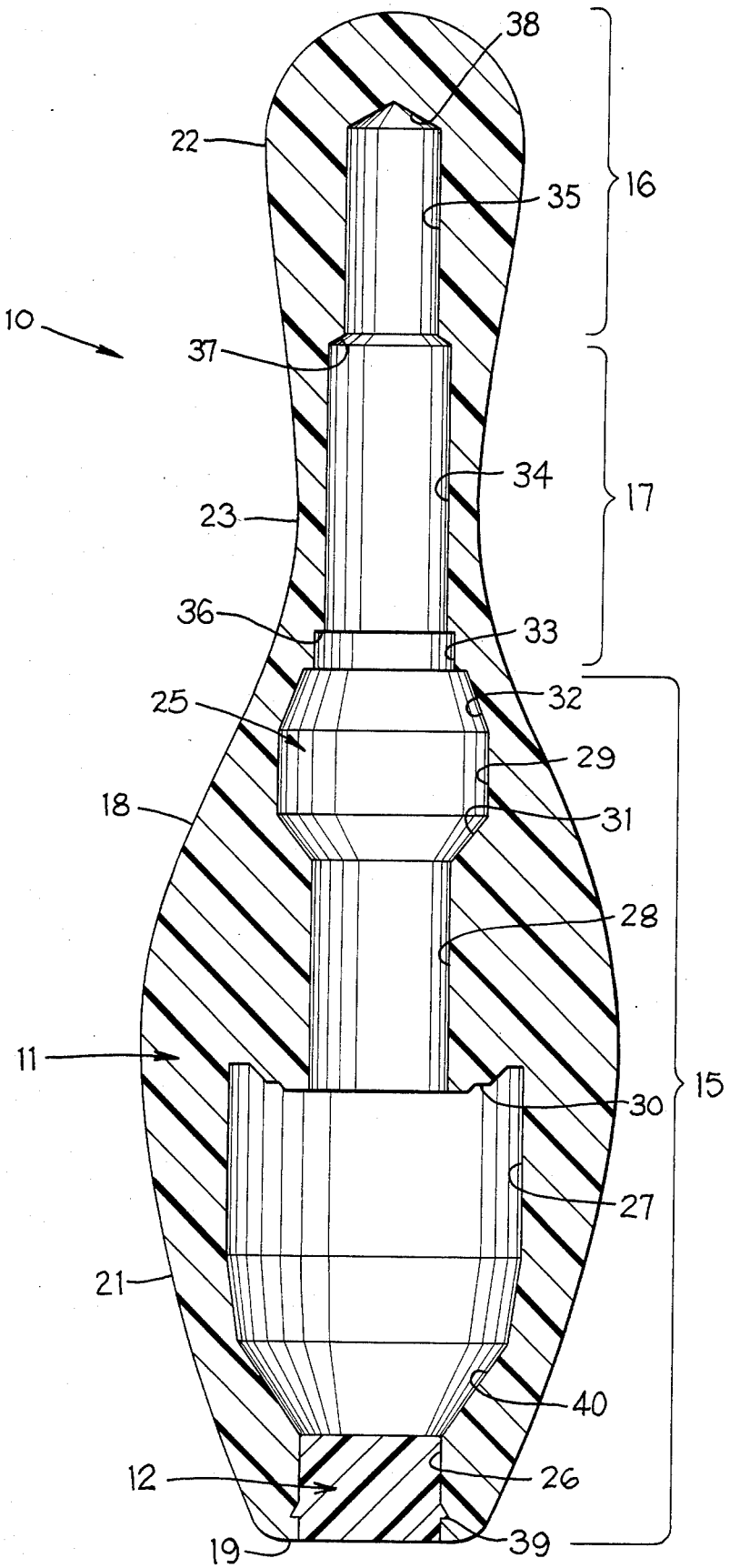
38
22
35
16
10
37
34
17
23
36
33
32
25
29
18
31
28
11
30
15
27
21
40
12
26
19
39

PLASTIC BOWLING PIN

FIELD OF THE INVENTION

This invention relates to a bowling pin and, more particularly, to an improved integrally molded plastic bowling pin which is basically of a one-piece integral arrangement and which closely simulates a wooden pin.

BACKGROUND OF THE INVENTION

Over the past twenty to thirty years, a large number of attempts have been made to construct a bowling pin either partially or wholly of resinous plastic materials in an attempt to provide a pin which is either more durable or less expensive than wooden pins, while at the same time retain the properties of wooden pins. In this regard, numerous patents disclose attempts to construct bowling pins of plastic, and some examples of such patents are the following: U.S. Pat. Nos. 4,351,786, 4,210,992, 4,165,875, 4,123,057, 4,012,386, 3,984,104, 3,971,837, 3,580,577, 3,572,710, 3,478,134, 3,346,258, 3,329,430, 3,301,560, 3,268,636, 3,231,274, 3,229,978, 3,251,598 and 3,169,766.

These numerous prior attempts to construct a bowling pin of resinous material, as by molding the pin or parts thereof of plastic, have been unsuccessful for numerous reasons. For example, many of the prior attempts have involved constructing the bowling pin of numerous individual plastic parts which are then assembled together, such being exemplified by aforementioned U.S. Pat. Nos. 3,251,598 and 4,351,530. Other attempts have involved the fabricating of the pin by constructing it of numerous different materials, such as by molding the core or some part of the pin of one material (such as a foamed plastic), and thereafter molding some or all of the remaining structure of the pin of a different material, such construction being exemplified by aforementioned U.S. Pat. Nos. 3,971,837 and 3,229,978. Still other attempts have involved using plastic in combination with wood or metal, such being illustrated by aforementioned U.S. Pat. Nos. 3,971,837 and 4,210,992. Construction techniques of the aforementioned types, however, are generally complex and expensive. Further, the multiple-part construction is generally expensive and effects pin durability.

Of most significance, however, with respect to the numerous prior attempts to construct bowling pins either wholly or partially of a plastic material is the inability of the plastic pin to possess the properties necessary to functionally react in a manner equivalent to a wooden pin. In this regard, the properties and characteristics of bowling pins are accurately determined and defined, which properties and characteristics have been defined in terms of wooden pins in view of their long and accepted usage. Hence, since a bowling pin has a very precise and well defined geometry, and also has very precisely defined properties such as weight, radius of gyration, center of gravity and the like, this being necessary in order for the pin to have the desired "action" when used in the sport of bowling, most prior plastic pins have hence been unable to conform to or meet the very rigid properties and characteristics defined for bowling pins and at the same time still possess the desired durability.

Accordingly, the present invention relates to an improved bowling pin constructed entirely of a plastic material, the pin being formed primarily by a one-piece integrally molded hollow plastic body which defines the entirety of the pin except for a small plastic plug which is seated in the bottom base surface of the pin for closing off the hollow interior of the body. This improved plastic pin has a hollow interior defined by a bore which extends concentrically throughout the longitudinal extent of the pin from the bottom plug to a point just short of the upper extremity of the pin. The hollow body is of predetermined contour throughout its length so that the pin possesses the required properties and characteristics so as to permit it to perform in a manner similar to a wooden pin. This plastic pin is also believed to provide significantly improved durability in comparison to a conventional wooden pin.

It has already been attempted to construct a bowling pin using a one-piece integrated molded plastic body as the primary pin structure, with this plastic primary body having a bore extending longitudinally upwardly therethrough, as illustrated by U.S. Pat. No. 4,012,386. However, this latter pin is not capable of possessing or conforming to the required properties and characteristics of the pin in accordance with defined standards, particularly since this latter pin due to its cross-section throughout its longitudinal extent will not possess a proper radius of gyration so as to permit it to react in the same manner as a wooden pin.

In contrast, the improved pin as defined in this application is believed to overcome the aforementioned disadvantages, including the disadvantages possessed by the pin of aforementioned U.S. Pat. No. 4,012,386.

Other objects and purposes of the invention will be apparent to persons familiar with structures of this type upon reading the following specification and inspecting the accompanying drawing.

BRIEF DESCRIPTION OF THE DRAWING

The single drawing illustrates therein a central elevational cross-sectional view of the improved bowling pin according to the present invention.

In the following description, the following terms will be used for convenience in the reference. For example, the words "upper", "lower", "right" and "left" will refer to directions in the drawing to which reference is made. The words "inwardly" and "outwardly" will refer to directions toward and away from, respectively, the center of the pin or designated portions thereof. Said terminology will include the words specifically mentioned, derivatives thereof, and words of similar import.

DETAILED DESCRIPTION

Referring to the drawing, there is illustrated a bowling pin 10 according to the present invention, which pin has an outer geometrical configuration which conforms to defined standards and hence is well known so that a definition of the overall size and outer configuration of the pin is hence believed unnecessary.

Pin 10 is defined primarily by a main body part 11 which is an integral one-piece plastic structure which is preferably formed by injection molding. This one-piece plastic main body par 11 extends throughout the full height of the bowling pin and defines the overall outer wall and outside configuration of the pin. This main plastic body part 11 is hollow, and has a plastic plug part 12 which closes off the lower end of the hollow interior.

Considering now the integral one-piece plastic main body 11, it defines a base portion 15 of the pin, the latter being of bulbous shape and joined to a rounded head portion 16 through the intermediate neck portion 17, the latter being integrally and smoothly joined between the portions 15 and 16 but being of lesser cross-section. This main one-piece plastic body part 11 defines thereon a bottom or base surface 19 which is substantially horizontally flat and is adapted to bear directly on a horizontal support surface, such as the alley surface, for permitting the pin to be supported in its upright position.

The main plastic body part 11 defines thereon the exposed outer surface 18 of the pin, the latter including a generally convex surface 21 which defines the annular side wall of the base portion 15, a convex surface 22 which defines the head portion 16, and a generally concave annular surface 23 which defines the neck portion 17. The concave surface 23 merges smoothly into the convex surfaces 21 and 22.

The main plastic body part 11 has a bore arrangement 25 which opens upwardly through substantially the entire length of the body part 11 so as to create a hollow interior within the pin 10. This bore arrangement 25 extends concentrically around the upright longitudinal axis of the pin and extends upwardly from the base surface 19 to a point located within the head portion 16. However, the bore arrangement 25 does not project through the upper end of the pin, but rather constitutes a blind bore.

This bore arrangement 25 includes multiple diameters which define multiple steps or shoulders as the bore arrangement project longitudinally upwardly throughout the pin. Starting first at the base surface 19, the bore arrangement includes a substantially cylindrical opening 26 which projects upwardly from the base surface 19 through a small extent. This cylindrical opening 26 is sized so as to fixedly accommodate the plug part 12 therein, as explained hereinafter.

The cylindrical opening 26 then communicates with a further coaxially aligned cylindrical opening 27, the latter being of significantly greater diameter than the opening 26 and joined with the latter through a truncated conical opening 40. This cylindrical opening 27 projects upwardly and terminates at an annular shoulder or wall 30 which is located substantially midway between the upper and lower ends of the base portion 15, this shoulder or wall 30 hence being located substantially at the point where the base portion 15 has its maximum diameter (as measured in horizontal cross-section). The cylindrical opening 27 preferably has a diameter which is approximately twice the diameter of the cylindrical opening 26.

Cylindrical opening 27 in turn communicates with a further cylindrical opening 28 which projects upwardly of the pin in coaxial alignment with the opening 27. This opening 28 hence projects upwardly from the wall or shoulder 30 and is preferably of substantially the same diameter as the cylindrical opening 26. The diameter of the opening 28 is approximately one half the diameter of the opening 27. This cylindrical opening 28 of uniform diameter projects upwardly over approximately one-fourth the height of the base portion 15, and then communicates with a further enlarged cylindrical opening 29, the latter being disposed in the upper part of the base portion 15 where the latter merges into the neck portion 17. The opening 29 is coaxially aligned with opening 28 and is joined thereto through a truncated conical opening 31. The opening 29 is of significantly greater diameter than the cylindrical opening 28, but is of significantly smaller diameter than the cylindrical opening 27. For example, cylindrical opening 29 preferably has a diameter which is numerically about midway between the numerical diameters of the openings 27 and 28. This opening 29 is also of significantly lesser axial extent than the opening 27. In fact, the opening 29 including the truncated conical openings 31 and 32 at opposite ends thereof extends axially over approximately one-fourth, and preferably slightly less than one-fourth, of the overall height of the base portion 15.

This cylindrical opening 29 at its upper end terminates in the upwardly converging truncated conical opening 32, the latter terminating in a coaxial upwardly extending cylindrical opening 33 which is an extension of the cylindrical opening 28 and hence is of the same diameter. This cylindrical opening 33 extends upwardly only a very short axial extent and effectively terminates at an annular shoulder or wall 36, the latter being disposed adjacent the lower end of the neck portion 17.

Bore arrangement 25 includes a further axially elongated cylindrical opening 34 which is coaxially aligned with and projects upwardly from the opening 33. Opening 34 is of only slightly smaller diameter than the cylindrical openings 28 and 33. For example, in the preferred embodiment, the cylindrical opening 34 has a diameter which is between about 80% and about 90% of the diameter of the opening 28. This cylindrical opening 34 extends upwardly throughout substantially the full axial extent of the neck portion 17 so as to terminate at a further annular wall or shoulder 37. This wall 37 is disposed substantially at the transition between the head and neck portions 16 and 17 respectively, and hence substantially at the transition from the concave surface 23 to the convex surface 22.

The bore arrangement 25 includes still a further cylindrical opening 35 which is coaxially aligned with opening 34 and projects upwardly from the wall 37. This opening 35 projects axially upwardly through a major upward extent of the head portion 16, with the opening 35 terminating at an end wall 38 which is spaced downwardly from the upper free end of the pin so as to wholly close off the upper end of the bore arrangement 25. This cylindrical opening 35 is of slightly smaller diameter than the opening 34 and, in the preferred embodiment, the opening 35 has a diameter which is preferably in the range of about 80% to about 90% of the diameter of the opening 34.

Considering now the plug part 12, it is constructed as a substantially cylindrical disc-shaped element formed as a solid one-piece plastic member, the plug part preferably being of the same plastic material as the main body part 11. Plug part 12 has a cylindrical outer surface which substantially conforms with and hence is snugly seated within the cylindrical opening 26. The plug part 12 preferably has an annular rib 39 projecting outwardly in surrounding relationship thereto, this rib being adapted to be seated within a small annular groove which surrounds the opening 26 and is slightly upwardly spaced from the base surface 19. This rib 39 has a tapered upper surface t facilitate slidable insertion of the plug part into the opening 26, whereupon the rib snaps into the groove to hence fixedly lock the plug part 12 to the body part 11. When so locked in position, the plug part 12 has its lower surface substantially flush with base surface 19, whereupon the pin 10 hence has a hollow interior which is fully closed off but which extends longitudinally over substantially the full height of the pin.

With the pin constructed as explained above, and as illustrated by the drawing, this hence results in the pin having a relatively thin wall construction over the lower half of the base portion 15, over the upper region of the base portion 15, and throughout substantially the vertical extent of the neck portion 17 and the head portion 16. However, due to the presence of the reduced diameter cylindrical opening 28 between the larger diameter openings 27 and 29, the base portion 15 hence includes a significant axial extent having an annular wall of substantially greater radial thickness. This annular wall of substantially greater radial thickness is defined throughout the axial extent of the cylindrical opening 28, and is hence disposed in the upper portion of the base portion 15 of the pin and in particular extends upwardly from the plane which is located in close proximity to the maximum pin diameter and thence extends upwardly to a location which is disposed closely adjacent to but spaced downwardly a small extent from the upper extremity of the base portion 15, this latter upper extremity being the point at which the outer convex surface 21 of the base portion merges into the concave surface 23 of the neck portion. This configuration and relationship hence provides the pin with the desired mass, the desired center of gravity, and the desired radius of gyration, while at the same time enabling the pin and specifically the main body part 11 to be integrally molded as a one-piece plastic structure.

The pin 10 of the present invention and specifically the main body part 11 is preferably molded of a high density plastic material. The molding preferably involves injection molding, and the plastic is preferably a thermoplastic and specifically a high density polyethylene.

The bore arrangement 25 within the body part 11 is preferably formed by machining.

Initial experimental testing and evaluation of the plastic pin of this invention have indicated that it does possess properties and characteristics which closely conform to a standard wooden pin. At the same time, with a pin having the construction of this invention as described above, no additional treatment of the exterior surface of the pin is necessary other than addition of typical neck stripping and other decorative characteristics.

Although a particular preferred embodiment of the invention has been described in detail for illustrative purposes, it will be recognized that variations or modifications of the disclosed apparatus, including the rearrangement of parts, lie within the scope of the present invention.

The embodiment of the invention in which an exclusive property or privilege is claimed are defined as follows:

1. A bowling pin constructed of two parts, comprising:

a main body part which is of an integral one-piece structure formed by injection molding of a hard high-density plastic material, said main body part having a substantially flat base surface defined on a lower end thereof which is adapted to bear against a alley surface for maintaining the bowling pin an upright condition, said main body part defining at an upper end thereof a rounded head which defines the upper extremity of the bowling pin, whereby said main body part extends throughout and defines the full vertical extent of the bowling pin;

said main body part including a base portion which projects upwardly from said base surface and is of a generally truncated bulbous configuration, said base portion being defined by a surrounding annular exterior surface which is of a generally convex configuration as it extends upwardly from the base surface, said base portion having a cross-section of maximum diameter located substantially midway between the upper and lower ends of the base portion;

said main body part including a neck portion which integrally joins to the upper end of said base portion and projects upwardly therefrom, said neck portion being of short upward extent and defining thereon a surrounding exterior annular surface which is of a generally concave configuration as it projects upwardly, the concave exterior surface of the neck portion merging smoothly with the convex exterior surface of the base portion;

said main body part including a head portion which is integrally joined to and projects upwardly from the upper end of said neck portion, said head portion being of short upward extent relative to said base portion and having a surrounding exterior annular surface which is generally convex as it projects upwardly and which at its lower end smoothly merges into the concave surface of said neck portion, the convex exterior surface of said head portion extending upwardly and wrapping around the upper end of the bowling pin to define a generally rounded convex end surface which closely resembles a semi-spherical shape;

said main body part having a continuous blind bore arrangement which opens upwardly from said base surface and extends upwardly in concentric relationship to the upright longitudinal central axis of the bowling pin, said bore arrangement terminating at its upper end in an end wall which is spaced downwardly a small distance from the exterior convex end surface, said bore arrangement including:

(a) a first substantially cylindrical bore which extends upwardly from said base surface through a small longitudinal extent, said first cylindrical bore being of substantially smaller diameter than said base surface, (b) a second substantially cylindrical bore extending upwardly from said first bore and being in open communication therewith through an intermediate truncated conical bore, said second cylindrical bore being of substantially greater diameter than said first bore and projecting upwardly so as to terminate at a downwardly-facing annular shoulder which is disposed at an elevation which is in the vicinity of the maximum cross-sectional diameter of said base portion, (c) a third substantially cylindrical bore communicating directly with and projecting upwardly from said second bore, said third bore being of substantially the same diameter as said first bore and projecting upwardly towards said end wall through a substantial vertical extent of said base portion, (d) a fourth substantially cylindrical bore communicating with and projecting directly upwardly from said third bore, said fourth bore being disposed in the vicinity of the upper end of said base portion, said fourth bore having a diameter which is significantly greater than the diameter of said third bore but is significantly less than the diameter of said second bore, (e) a fifth substantially cylindrical bore projecting upwardly from said fourth bore, said fifth bore being of smaller diameter than said fourth bore and projecting upwardly through said neck portion and partially through said head portion so as to terminate at said end wall; and a substantially cylindrical plug part fixedly seated within said first bore for closing off the lower end of said bore arrangement.

2. A bowling pin according to claim 1, wherein said fifth bore includes a first bore portion which projects upwardly from said fourth bore throughout substantially the full vertical extent of said neck portion and terminates at a second annular shoulder, said fifth bore including a second bore portion which axially communicates with and projects upwardly from said first bore portion throughout substantially the vertical extent of said head portion so as to terminate at said end wall, said second bore portion being of slightly smaller diameter than said first bore portion, and said first bore portion being of slightly smaller diameter than said third cylindrical bore.

3. A bowling pin according to claim 2, wherein said first and third cylindrical bores are of the same diameter, wherein said second cylindrical bore is approximately twice the diameter of said third cylindrical bore, and wherein said fourth cylindrical bore is approximately one and one-half times the diameter of said third cylindrical bore.

* * * * *